United States Patent [19]

Nerbas et al.

[11] 3,951,249

[45] Apr. 20, 1976

[54] DRIVE FOR THE MOVABLE PORTION OF A PRINTER

[75] Inventors: Dieter Nerbas; Peter Engler, both of Siegen, Germany

[73] Assignee: U.S. Philips Corporation, New York, N.Y.

[22] Filed: Nov. 18, 1974

[21] Appl. No.: 524,704

[30] Foreign Application Priority Data

Nov. 24, 1973 Germany ..... 2358682

[52] U.S. Cl. ..... 197/82; 197/16; 254/171

[51] Int. Cl.[2] ..... B41J 19/00

[58] Field of Search ..... 197/16, 18, 52, 55, 197/60, 82; 242/47.11; 254/148, 171, 186 R

[56] References Cited

UNITED STATES PATENTS

| | | | |
|---|---|---|---|
| 1,920,224 | 8/1933 | Weaver | 242/47.11 |
| 3,211,308 | 10/1965 | Glass | 254/148 X |
| 3,353,646 | 11/1967 | Young | 197/16 |
| 3,381,791 | 5/1968 | Cappotto | 197/82 X |
| 3,419,124 | 12/1968 | Sawaki | 197/18 X |
| 3,493,090 | 2/1970 | Liles | 197/16 |
| 3,519,115 | 7/1970 | Smith | 197/82 |
| 3,572,489 | 3/1971 | Schaefer | 197/82 |
| 3,677,384 | 7/1972 | Link | 197/16 |

*Primary Examiner*—Harland S. Skogquist
*Attorney, Agent, or Firm*—Frank R. Trifari; David R. Treacy

[57] ABSTRACT

A tape driving device in which the tape is helically wound around an axially displaceable cylinder. On rotation of the cylinder one end of the tape is taken up and the other is unwound at the same angle with respect to the cylinder. A remote guide roller is adapted to be locked in at least two positions to produce slack in the tape, which permits controlling a functional structure mounted on the carriage without affecting the movement of the carriage.

5 Claims, 1 Drawing Figure

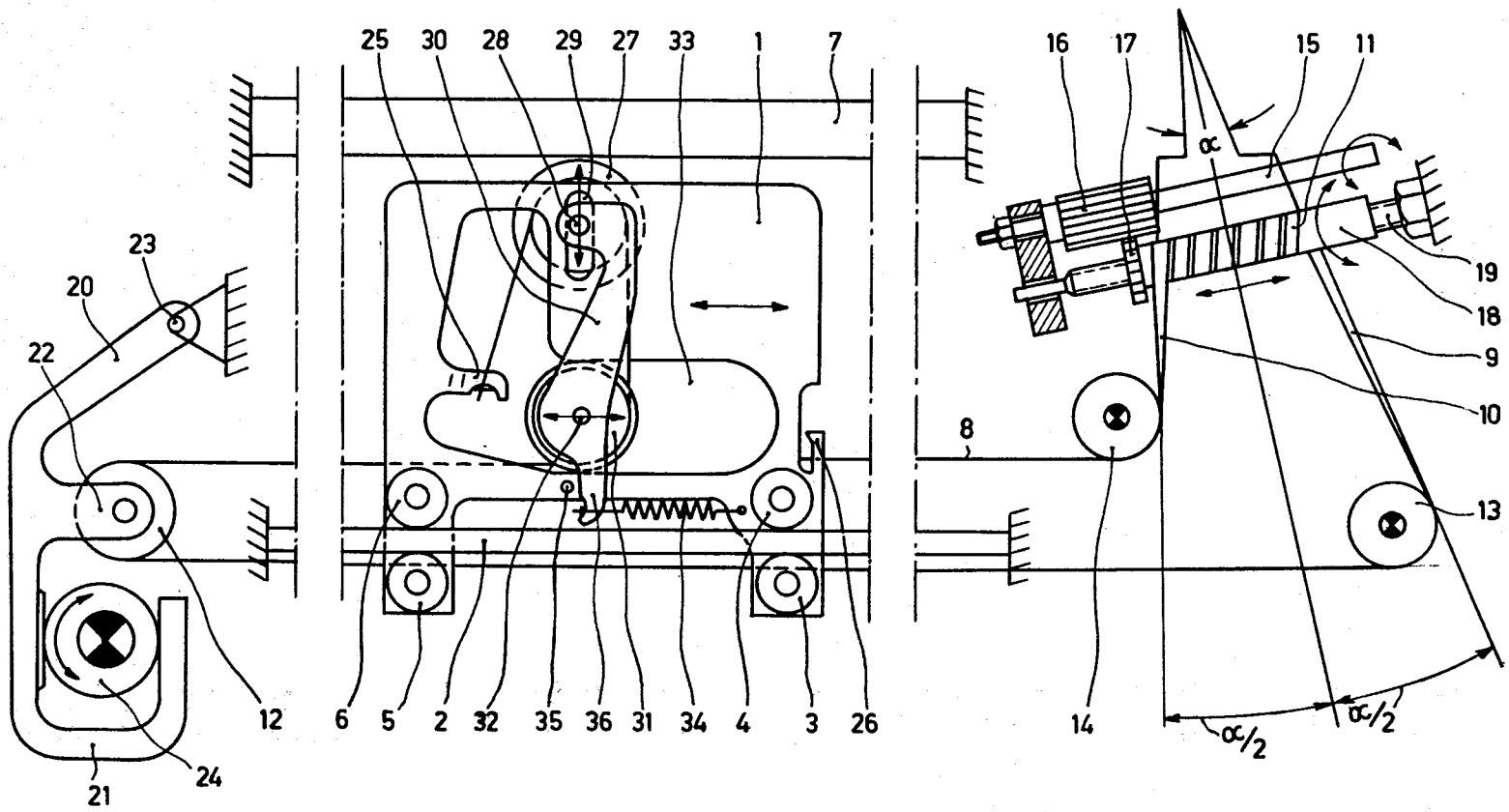
19
18
9
10
13
11
15
α
17
16
14
α/2
α/2
8
7
1
33
27
29
28
30
25
26
3
4
34
31
36
35
32
2
5
6
12
24
23
20
22
21

DRIVE FOR THE MOVABLE PORTION OF A PRINTER

BACKGROUND OF THE INVENTION

1. Field of the Invention

The invention relates to a device for driving the movable portion of a printer by means of a tape which is secured to a drum so as to be capable of being wound around the drum and unwound from it. In such a printer the drum is driven by a rotating motor in one direction or in the other.

2. Description of the Prior Art

In known drives of the type described the tape is wound around one drum and unwound from the other drum with the turns lying on each other, and the tape is led to the movable portion over guide rollers. Because the effective length of the flexible tape, which generally is made of steel, is not constant owing to the oppositely varying effective diameters of the take-up and take-off drums, at least one of the guide rollers must be pivotally mounted to obtain a resilient arrangement. In addition, positioning the portion to be moved, for example the carriage, of the printer requires a complicated and expensive control device owing to the aforementioned varying effective length.

SUMMARY OF THE INVENTION

An object of the present invention is to provide a simplified drive of a design such that the driving tape can also perform other moving functions for devices mounted on the moving portion, for example the function of pivoting the printer away from the platen or from the inked ribbon to facilitate the introduction of the sheet or tape to be printed. According to the invention the movable portion of the printer is driven by an arrangement based on a parallel motion known in mechanical engineering, in which two tapes are wound around a driven cylinder at an angle to one another and at their ends are attached to the part to be guided. According to another feature of the invention, a movable guide roller changes slack in the tape, and rollers carried on the movable portion respond to the slack to control another function.

BRIEF DESCRIPTION OF THE DRAWING

An embodiment of the invention will now be described by way of example with regard to the drawing, in which the sole FIGURE is a schematic view of an intermittent drive for a printing head which is mounted on a carriage which is arranged to be moved in steps. All details not relevant to the present invention have been omitted from the drawing.

DESCRIPTION OF THE PREFERRED EMBODIMENT

A carriage 1 carries in a known manner, not shown, a printing head arranged opposite a platen 7. The carriage 1 is adapted to be moved in steps in the directions indicated by the double-headed arrow and is guided along a guide bar 2 by rollers 3, 4, 5 and 6. Stepwise motion in both directions is effected by means of a steel tape 8 one end of which is secured to a securing stud 26 of the carriage 1 and is helically wound around a cylinder 18 via a guide roller 14. From the cylinder 18 the steel tape 8 is taken via guide rollers 13 and 12 to the other securing stud 25 of the carriage 1. The tape is guided by further guide rollers 31 and 27 the functions of which will be described hereinafter.

The guide rollers 13 and 14 are so arranged relatively to the cylinder 18 that parts 9 and 10 of the steel tape are helically wound around and unwound from the cylinder 18. The cylinder 18 is driven via a gearwheel 17 and a toothed cylinder 16 which is rigidly mounted on a driving shaft 15 which in turn can be driven in both directions of rotation by a driving motor, not shown.

Advantageously the steel tape 8 is secured to the cylinder 18 at a point 11 so as to prevent slipping. Such securing is particularly desirable if the stepwise motion is effected by a control signal which is not directly derived from the tape motion, for example by means of a slotted disk mounted on the driving shaft 15. The cylinder 18 is mounted on a stationary spindle 19 so as to be rotatable and axially slidable thereon, so that the cylinder can follow the take-up and take-off movement of the tape 8 in the directions indicated by the arrow. This ensures a constant takeup and take-off angle $\alpha$.

The guide roller 12, which is remote from the cylinder 18, may be stationary. For the carriage 1 to be moved in steps it is sufficient that the steel tape 8 after passing over the guide roller 12 is directly secured to the carriage 1 above the roller 6 in known manner, not shown.

To enable the steel tape 8 to perform other motional functions, for example pivoting away the printing head, lifting the inked ribbon, changing over or superposing a movement on the horizontal movement of the printer etc., in the embodiment shown the guide roller 12 is secured to a projecting part 22 of a lever 20 adapted to pivot about a pin 23. This pivotal movement is effected by means of an eccentric 24 which slides in a U-shaped extension 21 of the lever 20. If this eccentric is rotated through 180°, the guide roller 12 is deflected to the right. The steel tape 8 is slackened, permitting the spring 34, one end of which is secured to a lug 36 of a frame 30 whilst the other end is secured to the carriage 1, to pivot the frame 30 to the right in the direction indicated by the arrow. Spindles 28 and 32 on which are mounted the guide rollers 27 and 31 respectively are secured in the frame 30. The roller 31 is guided in a sliding bearing 33, and the roller 27 is arranged to slide in a slot 29 which extends at right angles to the bearing 33. If now after the tape 8 has been lifted by the spring 34 the guide roller 31 is moved to the right, the upper guide roller 27 is automatically moved down so that the printer, which is secured to the frame 30 in a manner not shown, is drawn away from the platen 7. During this operation the carriage 1 remains stationary. It remains stationary if in order to move the printer towards the platen 7 the eccentric is again rotated through 180° so that the guide roller 12 is moved to the left. As a result, the guide roller 31 is returned to the position shown against the action of the spring 34. For safety reasons a stop 35 is provided to prevent excessive movement if the spring 34 fails by fracture or ageing.

What is claimed is:

1. A device for driving the movable portion of a printer by means of a tape secured on a drum so as to be capable of being wound around and unwound from the drum, and connected to the movable portion via guide rollers, the drum being driven in one direction of rotation or in the other depending upon a desired direction of movement, wherein said drum comprises a circular cylinder having an axis, and said tape has first and second portions wound around said cylinder arranged as a helix having a given angle such that upon rotation of the cylinder one portion is wound and the other is unwound, and said device comprises two guide rollers each arranged to guide a portion of said tape leading from said helical winding and so disposed that said tape forms an angle with respect to the cylinder equal to half said given angle, and means for mounting said cylinder for rotation about said axis and for axial displacement so as to maintain said angle with respect to the cylinder constant.

2. A device as claimed in claim 1 wherein the tape is endlessly wound around the cylinder, and comprising means for securing the tape to the cylinder at a given point.

3. A device as claimed in claim 1, comprising in addition a third guide roller remote from the cylinder disposed so that a length of said tape passes at least partly around said third guide roller, and means for moving said third guide roller between at least two positions so as to change slack in the tape, and means responsive to said slack to enable a functional element to be set to at least two positions.

4. A device as claimed in claim 3 wherein said movable portion of the printer comprises two further rollers and means for mounting said further rollers for displaceable movement relative to said movable portion, and wherein at least a third portion of the tape is guided over said further rollers.

5. A device as claimed in claim 4 wherein said movable portion comprises a frame, means connecting said further rollers to said frame for rotation with respect to said frame but with fixed spacing between said further rollers, said frame being so arranged that tension in said tape tends to move said frame relative to the movable portion in a given direction, and biasing means for urging said frame opposite to said given direction.

* * * * *